US007618284B2

(12) United States Patent
Lamoureux et al.

(10) Patent No.: US 7,618,284 B2
(45) Date of Patent: Nov. 17, 2009

(54) ELECTRICAL ASSEMBLY HAVING AN OUTLET WITH BOTH POWER AND COMMUNICATIONS CONNECTORS

(75) Inventors: John E. Lamoureux, Plainfield, CT (US); Feng Jin, Milford, CT (US); Nathaniel L. Herring, Mystic, CT (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 11/896,283

(22) Filed: Aug. 30, 2007

(65) Prior Publication Data

US 2008/0160826 A1 Jul. 3, 2008

Related U.S. Application Data

(60) Provisional application No. 60/841,247, filed on Aug. 31, 2006.

(51) Int. Cl.
*H01R 13/60* (2006.01)

(52) U.S. Cl. ..... 439/535; 439/536; 439/538; 439/539; 439/136; 439/142; 174/53; 174/54; 174/58

(58) Field of Classification Search ..... 439/535, 439/536, 538, 539, 136, 142; 174/53, 54, 174/58

See application file for complete search history.

(56) References Cited

U.S. PATENT DOCUMENTS

| | | | | |
|---|---|---|---|---|
| 2,506,212 | A | 5/1950 | Grohsgal | |
| 2,675,527 | A | 4/1954 | Hartranft | |
| 3,371,149 | A | 2/1968 | Maxted | |
| 3,472,945 | A | 10/1969 | Trachtenberg | |
| 4,892,212 | A * | 1/1990 | Andreyko | 220/3.3 |
| 5,117,122 | A | 5/1992 | Hogarth et al. | |
| 5,243,134 | A | 9/1993 | Nattel | |
| 5,290,175 | A | 3/1994 | Robinson et al. | |
| 5,354,953 | A * | 10/1994 | Nattel et al. | 174/54 |
| 5,419,716 | A | 5/1995 | Sciammarella et al. | |
| 5,424,587 | A | 6/1995 | Federowicz | |
| 5,486,650 | A | 1/1996 | Yetter | |
| 5,574,256 | A | 11/1996 | Cottone | |
| 5,594,207 | A | 1/1997 | Fabian et al. | |
| 5,599,190 | A | 2/1997 | Willette | |
| 6,147,304 | A | 11/2000 | Doherty | |
| 6,194,657 | B1 * | 2/2001 | Gretz | 174/53 |
| 6,207,895 | B1 | 3/2001 | Engel | |

(Continued)

OTHER PUBLICATIONS

U.S. Appl. No. 12/216,543, filed Jul. 2008, Peck.

*Primary Examiner*—Tho D Ta
(74) *Attorney, Agent, or Firm*—Alan I. Cantor; Mark S. Bicks; Alfred N. Goodman

(57) ABSTRACT

An electrical assembly comprising an electrical box and a single gang electrical outlet having both a power connector and at least one communications connector and being supported in the box. The electrical outlet is receivable in the box, which has a barrier to isolate the power and communications connectors, but is not receivable in a standard box, which would not have the required barrier, due to the spacing and locations of the mounting fasteners and protrusions extending downwardly near the ends of the outlet. In addition to the electrical outlet with the power and communications connectors, the electrical box can receive a standard single gang outlet therein upon removal of the barrier.

55 Claims, 7 Drawing Sheets

U.S. PATENT DOCUMENTS 6,218,613 B1 4/2001 Justiniano et al.
6,259,020 B1 7/2001 Ashline et al.
6,376,770 B1 * 4/2002 Hyde ..... 174/58
6,492,591 B1 12/2002 Metcalf
6,573,446 B1 * 6/2003 Umstead et al. ..... 174/50
6,653,561 B2 11/2003 Lalancette et al.
6,727,428 B2 4/2004 Archer et al.
6,835,890 B2 12/2004 Dinh et al.
7,179,101 B2 * 2/2007 Murakami et al. ..... 439/142
2009/0014196 A1 1/2009 Peck

* cited by examiner

ELECTRICAL ASSEMBLY HAVING AN OUTLET WITH BOTH POWER AND COMMUNICATIONS CONNECTORS

CROSS-REFERENCE TO RELATED APPLICATION

This application claims the benefit under 35 U.S.C. § 119 (e) of Provisional Application No. 60/841,247, filed on Aug. 31, 2006, in the U.S. Patent and Trademark Office, the entire disclosure of which is hereby incorporated herein by reference.

FIELD OF THE INVENTION

The invention relates to an electrical assembly comprising an electrical box and a single gang electrical outlet having both a power connector and at least one communications connector, the outlet being supported in the box. A removable barrier is supported in the box to electrically isolate the power connector and the communications connector. When the barrier is removed, the electrical box can support a standard single gang outlet having two power connectors. The power/communications outlet is constructed so that it cannot be erroneously received in a standard electrical box which has no barrier therein, due to the spacing and locations of the mounting fasteners and protrusions extending downwardly near the ends of the outlet.

BACKGROUND OF THE INVENTION

Standard single gang electrical outlets typically have two power connectors for receiving electrical plugs from various electrical devices, such as lighting fixtures, computers, printers, telephones, toasters and other typical electrical devices found in homes and offices. With increased use of computers, televisions, and telephones, it is advantageous to have an outlet with at least one power connector and at least one communications connector, such as a coaxial television cable connector, and a voice and/or data cable connector, for their diversity.

However, known electrical outlets with both power and communications connectors have various disadvantages. Various electrical codes, for example, require a barrier between the power and communications connectors to electrically isolate for safety the relatively high voltage power connectors and the relatively low voltage communications convectors. This typically results in use of a barrier fixedly coupled to the electrical outlet or to the electrical box which complicates the manufacture process and increases manufacture costs. Fixedly connecting a barrier to an electrical box also limits the use of the box and increases inventories. In addition, due to the need for a barrier, electrical outlets supporting power connectors and communications connectors typically are formed as multi-gang outlets with two power connectors and two communications connectors, which increases manufacturing costs and provides unnecessary multiplicity of the connectors.

Complicating manufacture of outlets with power and communications connectors is the need to prevent these outlets from inadvertently being connected to conventional electrical boxes without the required barriers.

Examples of prior art electrical assemblies relating to electrical boxes and outlets are as follows, the disclosures of which are hereby incorporated herein by reference: U.S. Pat. No. 2,506,212 to Grohsgal, U.S. Pat. No. 2,675,527 to Hartranft, U.S. Pat. No. 3,371,149 to Maxted, U.S. Pat. No. 3,472,945 to Trachtenberg, U.S. Pat. No. 5,117,122 to Hogarth et al., U.S. Pat. No. 5,243,134 to Nattel, U.S. Pat. No. 5,290,175 to Robinson et al., U.S. Pat. No. 5,419,716 to Sciammarella et al., U.S. Pat. No. 5,424,587 to Federowicz, U.S. Pat. No. 5,486,650 to Yetter, U.S. Pat. No. 5,574,256 to Cottone, U.S. Pat. No. 5,594,207 to Fabian et al., U.S. Pat. No. 5,599,190 to Willette, U.S. Pat. No. 6,147,304 to Doherty, U.S. Pat. No. 6,207,895 to Engel, U.S. Pat. No. 6,218,613 to Justiniano et al., U.S. Pat. No. 6,259,020 to Ashline et al., U.S. Pat. No. 6,492,591 to Metcalf, and U.S. Pat. No. 6,727,428 to Archer et al.

SUMMARY OF THE INVENTION

Accordingly, an object of the present invention is to provide a single gang electrical outlet with a power connector and at least one communications connector that is relatively easy and cheap to manufacture and use in different environments and with different types of electrical boxes.

A further object of the present invention is to provide an electrical outlet with a power connector and at least one communications connector that can releasably receive a barrier therein, which barrier is also releasably coupled to an electrical box.

A further object of the present invention is to provide an electrical outlet with a power connector and at least one communications connector that will not be inadvertently connected to a standard electrical box having no barrier.

A further object of the present invention is to provide an electrical box that can receive both a standard electrical outlet having two power connectors, and an electrical outlet having a power connector and at least one communications connector.

The foregoing objects are basically attained by providing a single gang electrical outlet, the combination comprising: a main body having a first flange at a first end for receiving a first mounting fastener and a second flange at a second end for receiving a second mounting fastener; a first set of apertures in said main body adjacent the first end; a power connector coupled to said main body and in communication with said first set of apertures; at least one additional aperture in said main body adjacent the second end; and a first communications connector coupled to said main body and in communication with said at least one additional aperture.

The foregoing objects are also basically attained by providing an electrical assembly, the combination comprising: an electrical box having first and second ends and having a first supporting flange at said first end and a second supporting flange at said second end; a single gang electrical outlet comprising a main body having a first mounting flange at a first end for receiving a first mounting fastener, and a second mounting flange at a second end for receiving a second mounting fastener, a first set of apertures in said main body adjacent the first end, a power connector coupled to said main body and in communication with said first set of apertures, at least one additional aperture in said main body adjacent the second end, and a first communications connector coupled to said main body and in communication with said at least one additional aperture; said power connector and said first communications connector defining a slot therebetween; and a barrier coupled to said box and located in said slot for separating the power and first communications connector, said first mounting fastener being received in said first supporting flange and said second mounting fastener being received in said second supporting flange to couple said outlet to said box.

The foregoing objects are also basically attained by providing an electrical box, the combination comprising: a housing having a longitudinal axis; a first supporting flange located on said housing having a first aperture therein intersected by said longitudinal axis and a second aperture therein and transversely spaced from said longitudinal axis; and a second supporting flange located on said housing having a third aperture therein intersected by said longitudinal axis and a fourth aperture therein and transversely spaced from said longitudinal axis, said first and third apertures adapted to receive electrical outlet mounting fasteners coupled to a first outlet, and said second and fourth apertures adapted to receive electrical outlet mounting fasteners coupled to a second outlet which is different from the first outlet.

Other objects, advantages, and salient features of the invention will become apparent from the following detailed description, which, taken in conjunction with the annexed drawings, discloses preferred embodiments of the invention as defined in the annexed claims.

BRIEF DESCRIPTION OF THE DRAWINGS

Referring now to the drawings which form a part of this original disclosure.

DETAILED DESCRIPTION OF THE INVENTION

Figure 1:
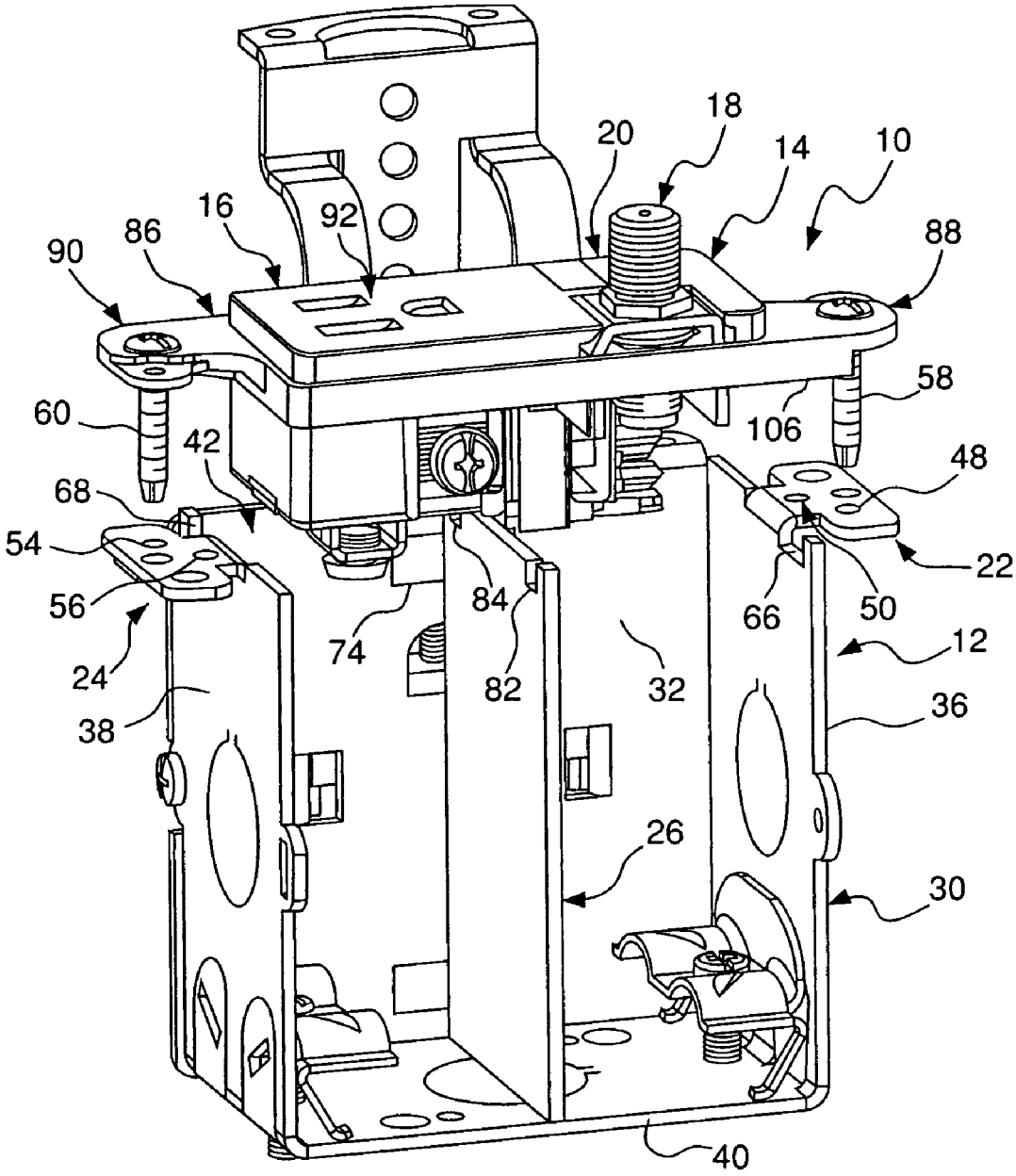
FIG. 1 is an exploded perspective view of the electrical box and single gang electrical outlet in accordance with the present invention with a side wall of the box removed for clarity.

As seen in FIGS. 1-11, the electrical assembly 10 in accordance with the invention comprises an electrical junction box 12 and a single gang electrical outlet 14 supported in the box 12, the outlet 14 having both a power connector 16 and two communications connectors 18 and 20 thereon. The box 12 has first and second supporting flanges 22 and 24 thereon to receive, respectively, first and second threaded mounting fasteners 58 and 60 on the outlet 14. The box 12 has a vertical barrier 26 therein to separate the power connector 16 and the two communications connectors 18 and 20 as required by electrical codes.

Outlet 14 and box 12 have respective mounting fasteners 58 and 60 and threaded mounting apertures 48 and 54 that allow the outlet 14 to be securely mounted to the box 12. However, the outlet 14 mounting fasteners 58 and 60 are so positioned that they cannot mount the outlet 14 to a standard electrical box, such as box 208 seen in FIG. 14, which would not have the required barrier therein. In addition, the outlet 14 has a pair of protrusions 106 and 108 that also prevent the outlet 14 from being mounted to a standard electrical box 208. On the other hand, box 12 has additional apertures 50 and 56 in supporting flanges 22 and 24 to mount a conventional dual-connector electrical power outlet 28, as seen in FIG. 11, to the box 12, as desired.

As seen best in FIGS. 1, 2 and 7-10, box 12 comprises a housing 30 having first and second side walls 32 and 34, first and second end walls 36 and 38, a bottom wall 40, and a rectangular opening 42 defined by the side and end walls. The housing walls are preferably substantially planar, and the housing has a longitudinal central axis 44 extending between the first and second ends defined by first and second end walls 36 and 38.

Figure 2:
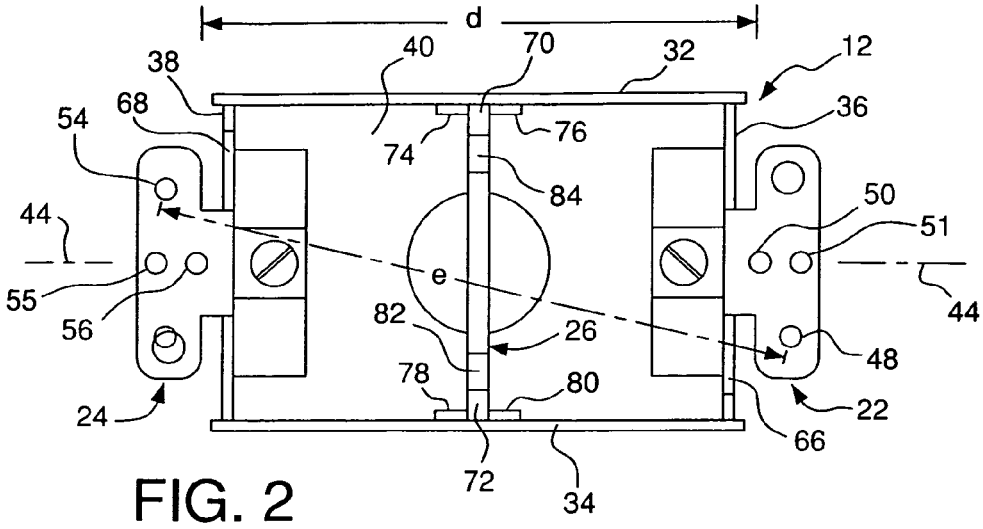
FIG. 2 is a top plan view of the electrical box shown in FIG. 1 with some parts removed for clarity.

The housing 30 has the first supporting flange 22 located adjacent the first end wall 36 having a first threaded aperture 50 therein intersected by longitudinal axis 44 and a second threaded aperture 48 therein transversely spaced and offset from axis 44 in a first direction. The housing 30 also has the second supporting flange 24 located adjacent the second end wall 38 having a third threaded aperture 56 therein intersected by the axis 44 and a fourth threaded aperture 54 therein and transversely spaced from and offset from axis 44 in a second direction opposite the first offset direction of second aperture 50. The centerlines of apertures 50 and 56 are separated by a distance "d", which is less than the distance "e" between the centerlines of apertures 48 and 54, as seen in FIGS. 2 and 11. Distance "d" is a standardized distance of about 3¼ inches on outlets having a length of about 3 inches and a width of about 1 7/16 inches. Distance "e" advantageously can be about 3⅝ inches.

Figure 11:
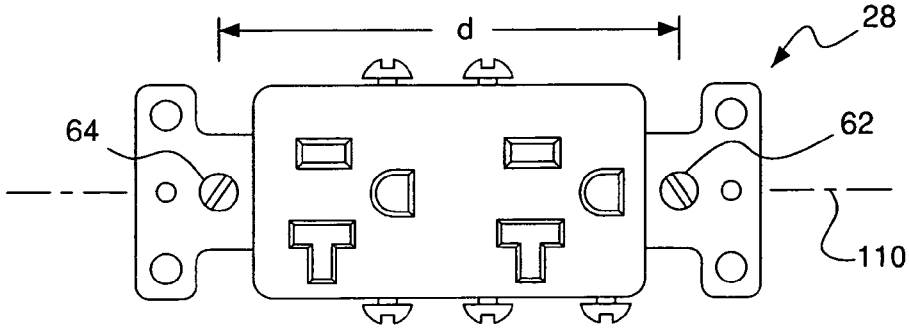
FIG. 11 is a top plan view of a conventional, standard dual connector electrical power outlet showing the standard location of the mounting fasteners.

The second and fourth apertures 48 and 54 are adapted to receive first and second mounting fasteners 58 and 60 from outlet 14 as seen in FIGS. 1-3 and 7, and the first and third apertures 50 and 56 are adapted to receive mounting fasteners 62 and 64 from standard conventional outlet 28, as seen in FIG. 11, outlets 14 and 28 being different by having different electrical connectors supported thereon and by having mounting fasteners in different locations. Outlet 28 mounting fasteners 62 and 64 are also receivable, respectively, in apertures 63 and 65 in standard box 208 seen in FIG. 14 which apertures have their centerlines also spaced a distance "d".

Box 208 also has additional flanges with apertures therein but they are for mounting the box to a wall not for mounting an outlet to the box.

As best seen in FIGS. 1, 2, and 8-10, first end wall 36 has a first upwardly-opening recess 66 therein at its top, and second end wall 38 has a second upwardly-opening recess 68 therein at its top, the first and second recesses being substantially U-shaped slots located on opposite sides of and transversely spaced and offset from axis 44.

Figure 8:
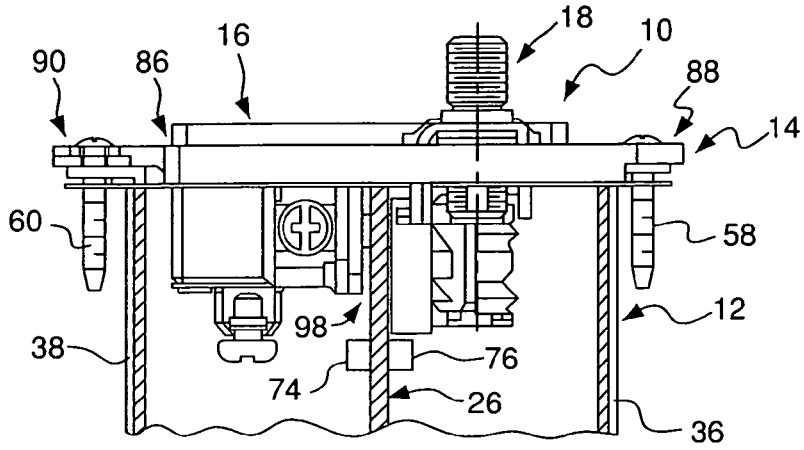
FIG. 8 is a side elevational view in partial section of the electrical outlet of FIGS. 1 and 3-6 coupled to the electrical box of FIGS. 1, 2 and 7.

As seen in FIGS. 1, 2 and 8, barrier 26 is a thin plate and is releasably coupled to housing 30 by being slidably received in first and second sets of vertically spaced slots 70 and 72 formed, respectively, in side walls 32 and 34 by series of opposed abutments 74 and 76 in side wall 32 and abutments 78 and 80 in side wall 34. Two upwardly opening stabilizing slots 82 and 84 are formed in the top of barrier 26 to receive, respectively, downwardly directed edges in opposite sides of the outlet 14 main body 86. Advantageously, barrier 26 is substantially planar, rectangular and made of non-conductive polymeric material.

As seen in FIGS. 1 and 3-10, single gang electrical outlet 14 is comprised of a main polymeric body 86 having a first mounting flange 88 integrally formed with body 86 at a first end for receiving the first mounting fastener 58, and a second mounting flange 90 integrally formed with body 86 at a second end for receiving the second mounting fastener 60. The main body 86 has a first set of apertures 92 adjacent the first end in communication with the electrical power connector 16 rigidly coupled to the main body and delivering 15 or 20 amps. The main body has two additional rectangular apertures 94 and 96 adjacent the second end in communication with and receiving the two communications connectors 18 and 20 therein via a conventional snap-fit. The communications connectors transmit, for example, voice, data, or video information and can be connectors for coaxial cables, Category 5 cables, telephone lines, and audio equipment cables.

Figure 5:
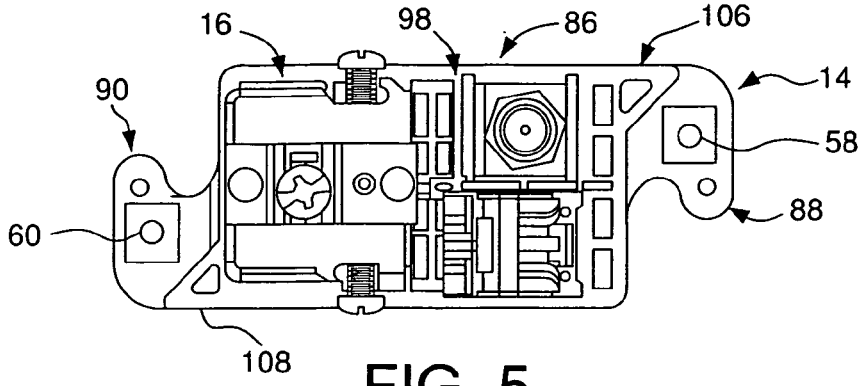
FIG. 5 is a bottom plan view of the electrical outlet shown in FIGS. 1 and 4.
Figure 6:
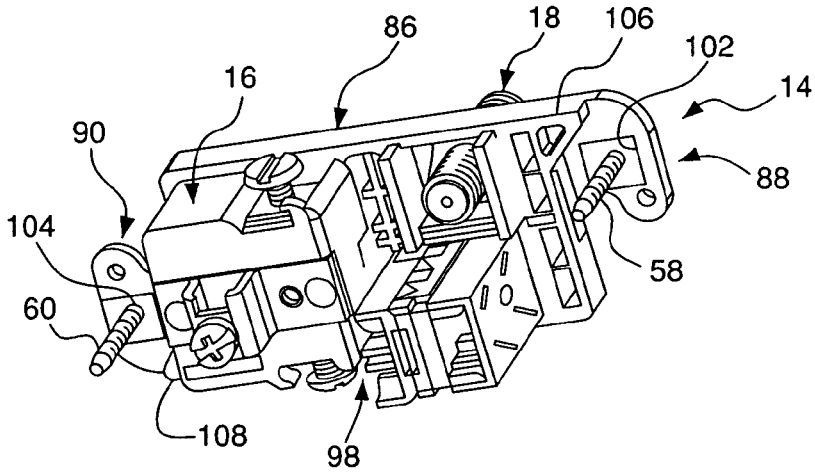
FIG. 6 is a bottom perspective view of the electrical outlet shown in FIGS. 1, 4 and 5.

Once the power connector 16 and the two communications connectors 18 and 20 are received on the main body as seen in FIGS. 1 and 3-10, they are spaced apart to define a vertical slot 98 therebetween below the main body. This slot 98 receives the barrier 26 therein once the outlet is connected to the box 12 to separate the power and communications connectors as required by electrical codes, as best seen in FIGS. 1, 5 and 8.

Figure 3:
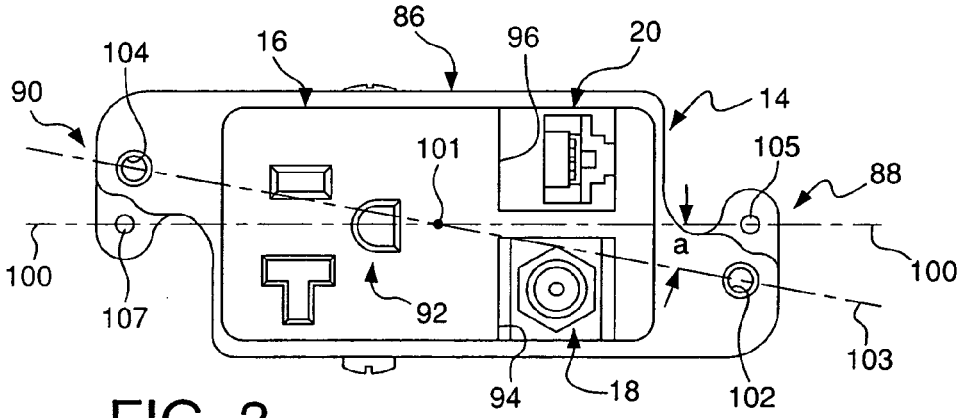
FIG. 3 is a top plan view of the electrical outlet shown in FIG. 1 with the mounting fasteners removed for clarity.
Figure 4:
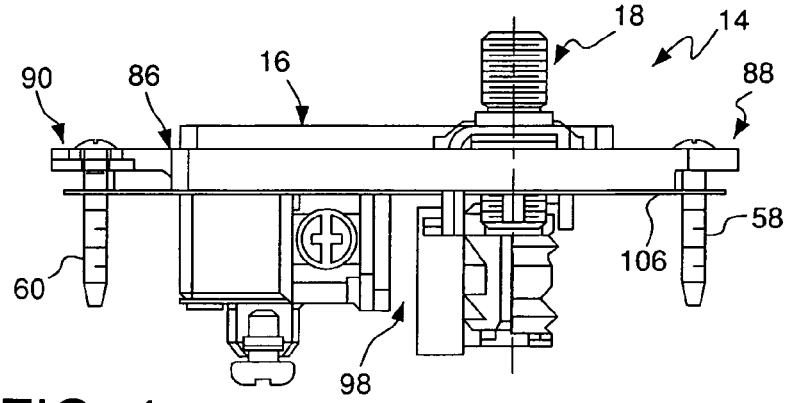
FIG. 4 is a side elevational view of the electrical outlet shown in FIG. 1 with the mounting fasteners in place.

The main body 86 has a longitudinal central axis 100, seen in FIG. 3, extending between first and second ends of the body, the first mounting flange 88 having a first opening 102 for receiving the first mounting fastener 58, this first opening being located on a first side and spaced and transversely offset from the axis 100. The main body 86 second mounting flange 90 has a second opening 104 therein for receiving the second mounting fastener 60, this second opening being located on a second side, which is opposite the first side, and spaced and transversely offset from the axis 100. Main body 86 has a center point 101 midway between the ends and sides of the body, and a line 103 extending through center point 101 and the centerlines of openings 102 and 104 forms an angle "a" with longitudinal central axis 100 of about 8° to about 12° degrees, and preferably about 10°. Additional smaller openings 105 and 107 can be formed in outlet 14 along axis 100 for receipt of additional fasteners for further support and/or a face plate. Box 12 has additional threaded apertures 51 and 55 along axis 44 to receive such additional fasteners.

The first mounting flange 88, as best seen in FIGS. 1, 5, 6 and 8-10, has a downwardly extending triangular first protrusion 106 that will be received in slot 66 in box 12 when the box 12 and outlet 14 are coupled together. Similarly, second mounting flange 90 has a downwardly extending triangular second protrusion 108 that will be received in slot 68 in box 12 when the box and outlet are coupled together. Advantageously, the outer straight edge of each protrusion 106 and 108 slidably engages the outer edges of slots 66 and 68, respectively, to keep the outlet 14 and box 12 in the desired alignment, which has opening 102 in flange 88 aligned with aperture 48 in flange 22 so that fastener 58 is readily received in both, and opening 104 in flange 90 aligned with aperture 54 in flange 22 so that fastener 60 is readily received in both.

Assembly and Operation

To assemble the electrical box 12 and outlet 14 in a configuration to deliver both power and communication, the outlet 14 is first asssembled with power connector 16 and communications connectors 18 and 20 coupled to main body 86 as seen in FIGS. 1 and 3-10. Barrier 26 is also inserted into housing 30 in box 12.

Figure 7:
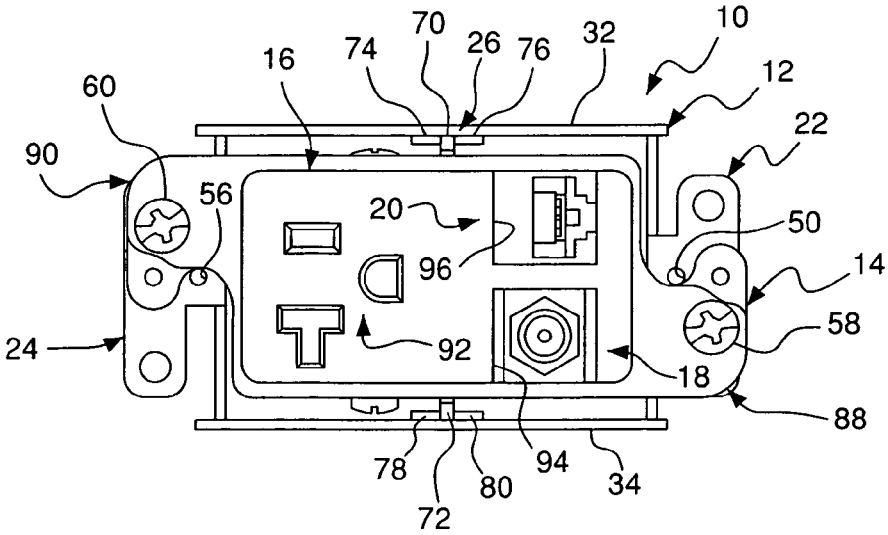
FIG. 7 is a top plan view of the electrical outlet of FIGS. 1 and 3-6 coupled to the electrical box of FIGS. 1 and 2.
Figure 9:
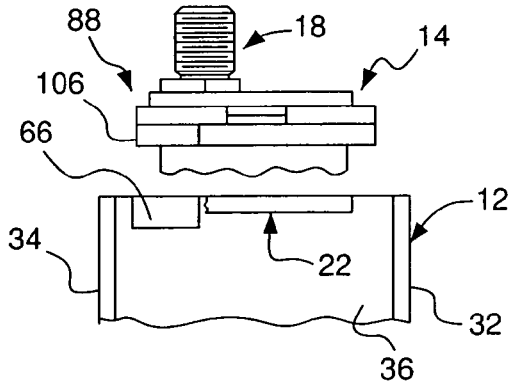
FIG. 9 is a partial, right end elevational view of the electrical outlet of FIGS. 1 and 3-8 aligned with and about to be coupled to the electrical box of FIGS. 1, 2 and 7.
Figure 10:
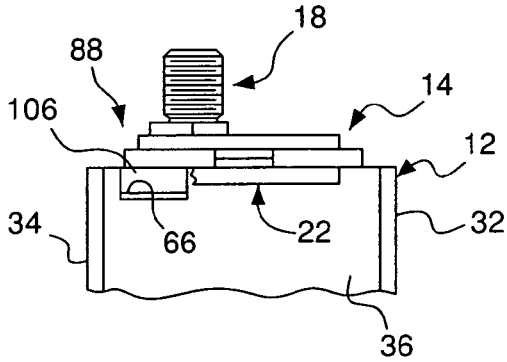
FIG. 10 is a partial, right end elevational view of the electrical outlet and electrical box of FIG. 9 but with the outlet engaged with the box and the protrusion on the outlet received in the recess in the wall of the box.

Next, outlet 14 is aligned with box 12 such that fasteners 58 and 60 at opposite ends of the outlet 14 can be threadedly received in threaded apertures 48 and 54 at opposite ends of the box 12, as indicated in FIGS. 1 and 7. At the same time, the protrusions 106 and 108 at opposite ends of the outlet 14 are aligned with and received in recesses 66 and 68 at opposite ends of the box 12 as seen in FIGS. 9 and 10. The fasteners 58 and 60 can then be tightened in apertures 48 and 54 as seen in FIGS. 7 and 8.

When the outlet 14 is received on box 12, the barrier 26 is fully received in the slot 98 between power connector 16 and communications connectors 18 and 20, and preferably the top of the barrier 26 engages the bottom of the main body 86 in the outlet 14. This placement of the barrier safely separates the power and communications connectors.

Figure 14:
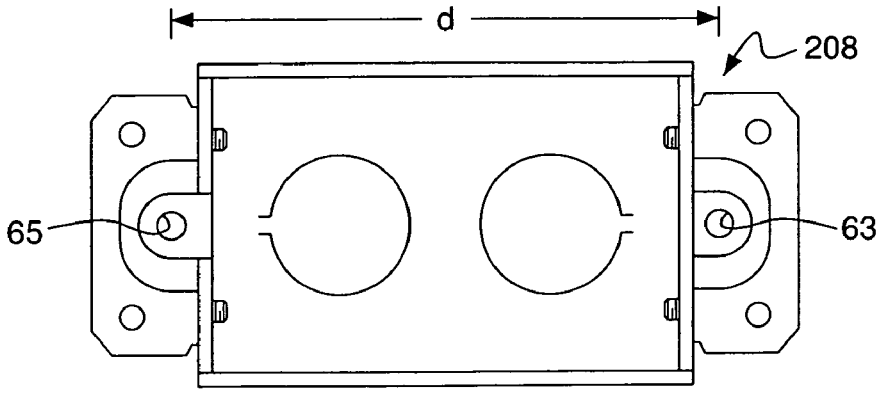
FIG. 14 is a top plan view of a standard electrical box which can be coupled to a standard electrical outlet but not the outlet of FIGS. 1 and 3-10.

If an installer were to try to couple the outlet 14 to a conventional electrical box 208 as seen in FIG. 14, the outlet would not align with or fit with the box. The transversely offset fasteners 58 and 60 do not align with the standard locations of the threaded apertures 63 and 65 on a standard electrical box, which are separated by a distance "d" and are substantially along the longitudinal central axis of the box 208. As illustrated in FIG. 11, the longitudinal axis 110 of a standard outlet 28 would align with such an axis in a standard box 208 and fasteners 62 and 64 would threadedly mate with threaded apertures 63 and 65 in box 208.

In addition, the protrusions 106 and 108 on the outlet 14 would engage the top edges of the ends of the standard box 208, thereby preventing the outlet 14 from being received in the standard box 208.

On the other hand, if desired, the standard outlet 28 shown in FIG. 11 can be coupled to box 12 by engaging standard mounting fasteners 62 and 64 on box 12 in standard apertures 50 and 56 as shown in FIG. 1, which are located in positions and spaced a distance "d" to readily receive fasteners 62 and 64.

Preferably before the outlet 14 is actually coupled to the box 12, suitable electrical power conduits and communications cables are introduced into the inside of the box through suitably removed knockout discs and the conduits and cables are coupled to the power and communications connectors in a conventional manner.

Figure 12:
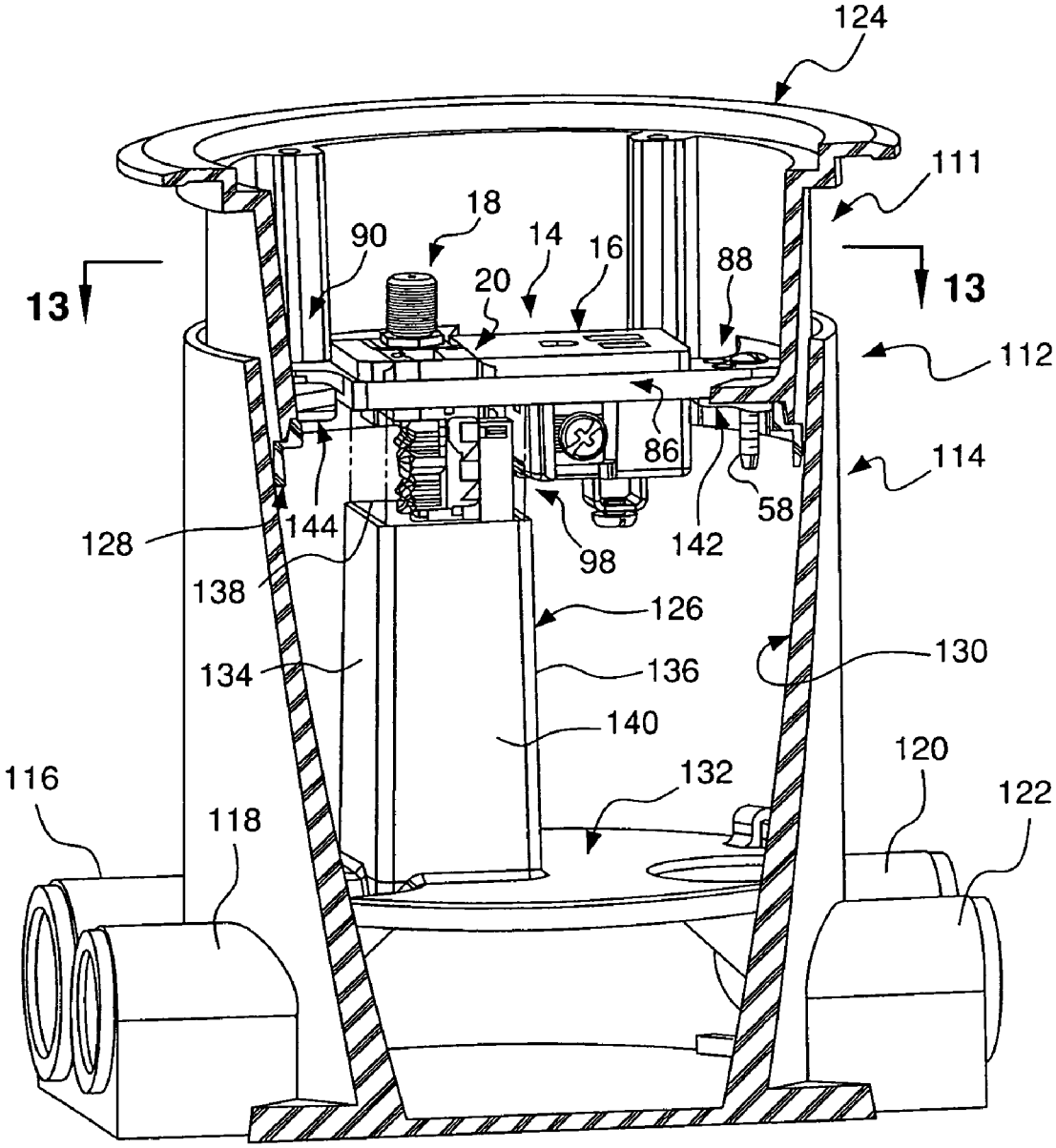
FIG. 12 is a partial perspective view of a second embodiment of the present invention with the electrical outlet in FIGS. 1 and 3-10 being coupled to a round PVC electrical floor box.
Figure 13:
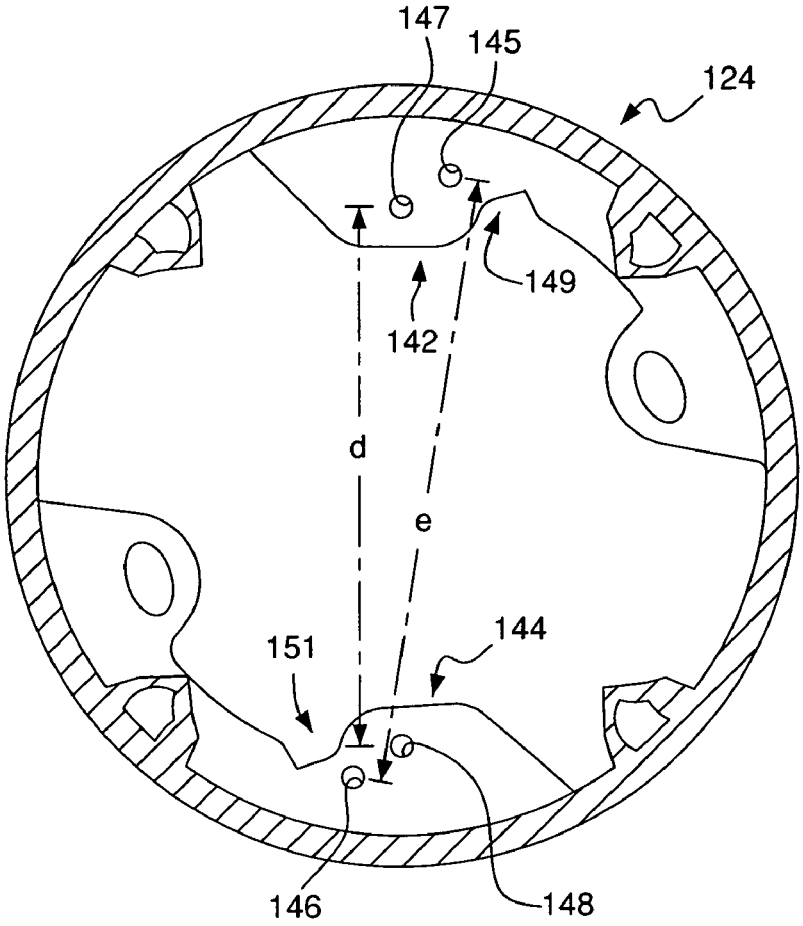
FIG. 13 is a top plan view in cross-section taken along line 13-13 in FIG. 12 of the carpet ring without the outlet for clarity but showing the outlet supporting flanges and recesses for the protrusions on the outlet.

Embodiment of FIGS. 12 and 13

As seen in FIGS. 12 and 13, a second embodiment of the present invention utilizes the same single gang electrical outlet 14 of FIGS. 1 and 3-10 but with a round PVC floor box 112 and a removable tubular barrier 126 to form electrical assembly 111.

The PVC floor box 112 comprises a tubular body 114 with hollow electrical conduit hubs 116, 118, 120 and 122 at the bottom, a tubular carpet flange 124 slidably received in the tubular body 114, and a leveling ring 128 engaging the bottom of the carpet flange 124 and slideably engaging the inner surface 130 of the tubular body, the ring 128 having a plurality of flexible legs that resiliently engage the inner surface of the tubular body.

A circular platform 132 is located near the bottom of the tubular body 114 and supports the tubular barrier 126 thereon. The barrier 126 is advantageously formed by a left side wall 134, a right side wall 136, a rear wall 138, and a front wall 140, these walls being slightly upwardly and inwardly tapered and forming a substantially rectangular transverse cross section for the barrier 126. As in the previous embodiment, barrier 126 is advantageously formed of polymeric material and electrically isolates the relatively low voltage communications connectors 18 and 20 on outlet 14 from the relatively high voltage power connector 16 once the outlet 14 and box 112 are fully connected. Advantageously, platform 132 has an opening therein communicating with the inside of barrier 126 so the electrical wires from the hubs can be attached to the communications connectors.

The carpet flange 124 has opposed, inwardly-facing first and second supporting flanges 142 and 144 rigidly coupled thereto having suitable threaded apertures 145 and 146 therein, like apertures 48 and 54 in outlet 14, to similarly receive mounting fasteners 58 and 60, as in outlet 14, to couple the outlet 14 to box 112. Likewise, these first and second supporting flanges 142 and 144 have suitable threaded apertures 147 and 148 therein, like apertures 50 and 56 in outlet 14, to receive mounting fasteners 62 and 64 in a standard outlet 28 seen in FIG. 11 having two power connectors therein as desired. As seen in FIG. 13, apertures 147 and 148 have their centerlines separated by a distance "d" that is less than the distance "e" between the centerlines of apertures 145 and 146 receiving fasteners 58 and 60 in outlet 14. Therefore, standard outlet 28 in FIG. 11 can be coupled to box 112 if desired, but outlet 14 cannot be inadvertently coupled to a standard box 208 seen in FIG. 14.

As seen in FIG. 13, flange 142 has a recess 149 formed therein offset transversely from aperture 145, and flange 144 has a recess 151 formed therein offset transversely from aperture 146, these recesses receiving the protrusions 106 and 108 on outlet 14 therein when the outlet is coupled to box 112 as seen in FIG. 12.

To assemble the electrical assembly shown in FIGS. 12 and 13 formed from outlet 14 and box 112, first electrical wires are run through the hubs 116, 118, 120 and 122 and then up through suitable openings in the platform 132 to be connected to the power connector 16 and through the opening below the barrier 126 and through the barrier to be connected to the communications connectors 18 and 20. Platform 132 can be adjusted vertically relative to the top of body 114 as desired.

Next, the outlet 14 is coupled via mounting fasteners 58 and 60 to the supporting flanges 142 and 144 on carpet ring 124 with protrusions 106 and 108 fitting into recesses 149 and 151. Then carpet ring 124, leveling ring 128 and outlet 14 are moved downwardly into tubular body 114 to the desired height until the top of the barrier 126 engages the bottom of main body 86 of outlet 14. In this position, right side wall 136 of barrier 126 is fully received in slot 98 between the power connector 16 and the two communications connectors 18 and 20 to isolate them from one another and the entire barrier 126 surrounds the two communications connectors.

Advantageously, barrier 126 is removably coupled to platform 132, by being snap-fitted into a suitable opening in the platform for example, so it can be removed and a standard electrical outlet 28, seen in FIG. 11, can be installed instead of outlet 14, as desired, with mounting fasteners 62 and 64 being threadedly received in apertures 147 and 148.

Figure 15:
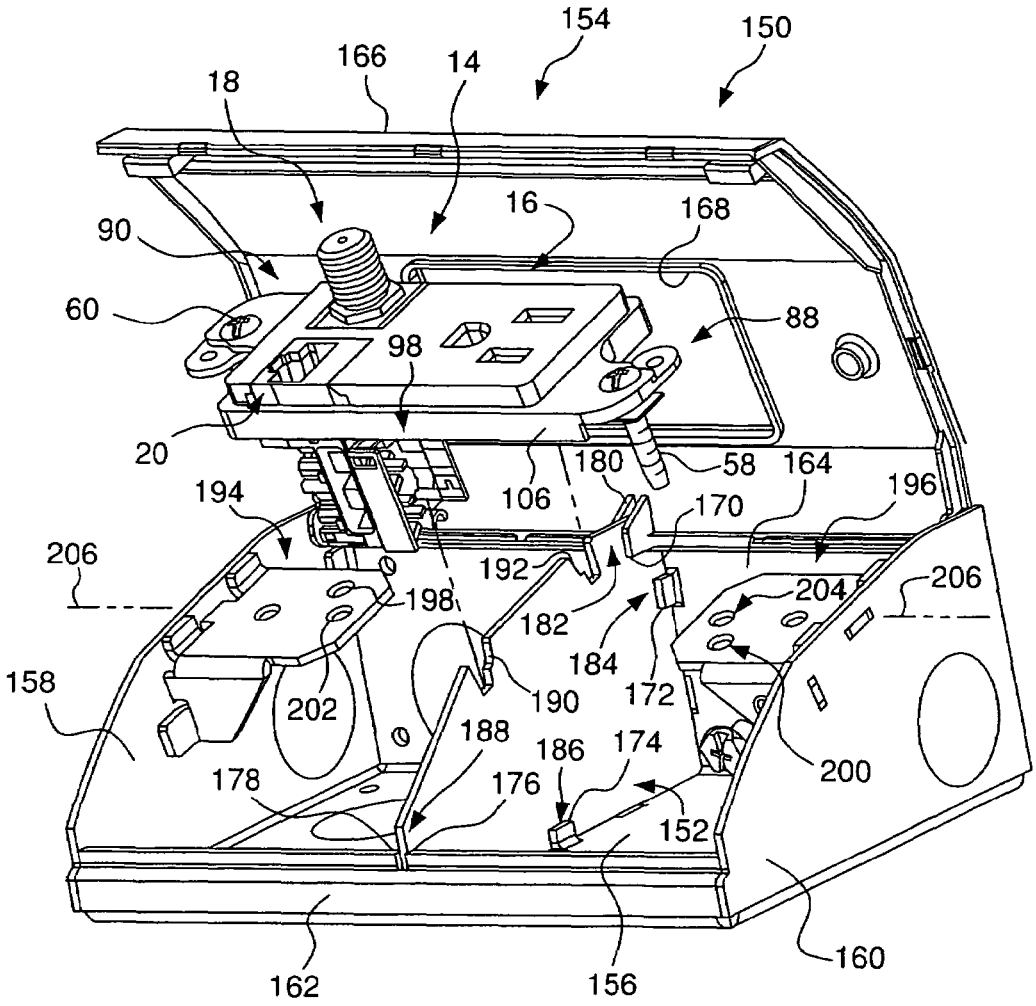
FIG. 15 is a perspective view of a third embodiment of the present invention with the electrical outlet of FIGS. 1 and 3-10 being coupled to an electrical box for mounting under a cabinet or a counter, the lower portion of the power connector being removed for clarity.

Embodiment of FIG. 15

As seen in FIG. 15, a third embodiment of the present invention uses the same single gang electrical outlet 14 of FIGS. 1 and 3-10 but with an under cabinet or counter box 150 and a planar removable barrier 152 to form electrical assembly 154.

Box 150 has a bottom wall 156, a left side wall 158, a right side wall 160, a low front wall 162, and a rear wall 164 hingedly supporting a curved top wall 166 thereon, the top wall having an opening 168 to allow access from the outside of the box 150 to the outlet 14.

Box 150 has a series of abutments 170, 172, 174, 176, 178 and 180 defining four slots 182, 184, 186 and 188 for removably supporting the barrier 152 in the box 150. As seen in FIG. 15, the barrier 152 is supported by the slots formed in the rear wall 164, bottom wall 156, front wall 162, and has two upwardly-opening slots 190 and 192 therein for receiving side edges of the outlet 14 main body 86.

Box 150 has opposed, inwardly-facing first and second supporting flanges 194 and 196 rigidly coupled, respectively, to left and right side walls 158 and 160, having threaded apertures 198 and 200, respectively, therein for threadedly receiving threaded fasteners 60 and 58 as seen in FIG. 15 to couple outlet 14 to box 150. In this case, flanges 194 and 196 are planar and the protrusions 106 and 108 on outlet 14 do not engage or interfere with the flanges since apertures 198 and 200 are located close enough to the edges of the flanges.

As in box 14 and box 112 in FIGS. 1-12 above, the first and second supporting flanges 194 and 196 have threaded apertures 202 and 204 therein along the longitudinal central axis 206 of the box 150, as seen in FIG. 15, and at a standard distance apart to receive therein mounting fasteners 62 and 64 in a standard outlet 28 seen in FIG. 11 having two power connectors therein, as desired.

Once box 150 is located in its desired place under a cabinet or counter, suitable electrical wires can be introduced into the inside of the box via removable of knock-out discs. The barrier 152 is put in place and the electrical wires are suitably connected to the power connector 16 and communications connectors 18 and 20. Then, the outlet 14 can be coupled to the box 150 via fasteners 58 and 60 and apertures 198 and 200 in the flanges on the box, with the barrier 152 being received in the slot 98 between the power and communications connectors to isolate them. Finally, the top wall 166 can be closed with the outlet 14 being accessible via opening 168 for placement of an electrical plug into the power connector 16 and a coaxial TV cable and computer or telephone cable into the communications connectors 18 and 20.

While advantageous embodiments have been chosen to illustrate the invention, it will be understood by those skilled in the art that various changes and modifications can be made therein without departing from the scope of the invention as defined in the appended claims.

What is claimed is:

1. A single gang electrical outlet, the combination comprising:

a main body having first and second ends and sized to fit within a single gang electrical box;

a first mounting flange extending outwardly from said main body at its first end for receiving a first mounting fastener;

a second mounting flange extending outwardly from said main body at its second end for receiving a second mounting fastener;

a first set of apertures in said main body adjacent the first end;

a power connector coupled to said main body and in communication with said first set of apertures;

at least one additional aperture in said main body adjacent the second end; and a first communications connector coupled to said main body and in communication with said at least one additional aperture.

2. A single gang electrical outlet according to claim 1, and further comprising a second additional aperture in said main body adjacent the second end; and a second communications connector coupled to said main body and in communication with said second additional aperture.

3. A single gang electrical outlet according to claim 1, and further comprising a slot located below said main body and between said power connector and said first communications connector.

4. A single gang electrical outlet according to claim 1, wherein said main body has a longitudinal central axis extending between said first and second ends, said first mounting flange has a first opening therein for receiving said first mounting fastener, said first opening being located on a first side of said longitudinal central axis, and said second mounting flange has a second opening therein for receiving said second mounting fastener, said second opening being located on a second side of said longitudinal central axis which is opposite said first side thereof.

5. A single gang electrical outlet according to claim 1, wherein said main body has a longitudinal central axis extending between said first and second ends, said first mounting flange has a first opening therein for receiving said first mounting fastener, said first opening being offset from said longitudinal central axis on a first side of said longitudinal central axis, and said second mounting flange has a second opening therein for receiving said second mounting fastener, said second opening being offset from said longitudinal central axis on a second side of said longitudinal central axis which is opposite said first side thereof.

6. A single gang electrical outlet according to claim 1, wherein said main body has a longitudinal central axis, and said first mounting flange has a first opening therein for receiving said first mounting fastener, said first opening being located on a first side of said longitudinal central axis.

7. A single gang electrical outlet according to claim 1, and further comprising a first protrusion extending downwardly from said first mounting flange.

8. A single gang electrical outlet according to claim 7, and further comprising a second protrusion extending downwardly from said second mounting flange.

9. A single gang electrical outlet according to claim 6, wherein said main body has a center point along said longitudinal central axis, and a line intersecting said center point and the centerline of said first opening is angled about 10° from said longitudinal central axis.

10. A single gang electrical outlet according to claim 6, wherein said main body has a center point along said longitudinal central axis, and a line intersecting said center point and the centerline of said first opening is angled about 8° to about 12° from said longitudinal central axis.

11. A single gang electrical outlet according to claim 1, wherein said first mounting flange is integrally formed with said main body, and said second mounting flange is integrally formed with said main body.

12. An electrical assembly, the combination comprising:

an electrical box having first and second ends, which define at least a portion of an opening of said box, and having a first supporting flange at said first end and a second supporting flange at said second end;

a single gang electrical outlet mounted in said box at said opening thereof and comprising a main body having a first mounting flange at a first end for receiving a first mounting fastener, and a second mounting flange at a second end for receiving a second mounting fastener, a first set of apertures in said main body adjacent the first end, a power connector coupled to said main body and in communication with said first set of apertures, at least one additional aperture in said main body adjacent the second end, and a first communications connector coupled to said main body and in communication with said at least one additional aperture;

said power connector and said first communications connector defining a slot therebetween; and a barrier coupled to said box and located in said slot for separating the power and first communications connector, said first mounting fastener being received in said first supporting flange and said second mounting fastener being received in said second supporting flange to couple said outlet to said box.

13. An electrical assembly according to claim 12, wherein said box has means for releasably receiving said barrier therein.

14. An electrical assembly according to claim 13, wherein said means for releasably receiving said barrier comprises a pair of opposed slots formed in opposite sides of said box.

15. An electrical assembly according to claim 12, wherein said barrier is substantially planar.

16. An electrical assembly according to claim 12, wherein said barrier is substantially tubular.

17. An electrical assembly according to claim 12, wherein said first mounting flange has a downwardly extending first protrusion thereon.

18. An electrical assembly according to claim 17, wherein said first end of said box has a first recess for receiving said first protrusion therein.

19. An electrical assembly according to claim 18, wherein said second mounting flange has a downwardly extending second protrusion thereon, and said second end of said box has a second recess for receiving said second protrusion therein.

20. A single gang electrical box, the combination comprising:

a single gang housing having first and second side walls, first and second end walls, a bottom wall, and a opening defined by said first and second side and end walls;

said housing having a longitudinal central axis extending between said first and second end walls;

a first supporting flange located adjacent said first end wall having a first threaded aperture therein intersected by said longitudinal central axis and a second threaded aperture therein and transversely spaced from said longitudinal central axis; and a second supporting flange located adjacent said second end wall having a third threaded aperture therein intersected by said longitudinal central axis and a fourth threaded aperture therein and transversely spaced from said longitudinal central axis, said first and third apertures adapted to receive electrical outlet mounting fasteners coupled to a first outlet, and said second and fourth apertures adapted to receive electrical outlet mounting fasteners coupled to a second outlet which is different from the first outlet.

21. A single gang electrical box according to claim 20, wherein said second aperture is transversely spaced from said longitudinal central axis in a first direction.

22. A single gang electrical box according to claim 21, wherein said fourth aperture is transversely spaced from said longitudinal central axis in a second direction opposite from said first direction.

23. A single gang electrical box according to claim 20, wherein said first end wall has a first recess therein for receiving a first portion of an outlet therein.

24. A single gang electrical box according to claim 23, wherein said second end wall has a second recess therein for receiving a second portion of an outlet therein.

25. A single gang electrical box according to claim 20 and further comprising a barrier extending between said first and second side walls substantially perpendicular to said longitudinal central axis.

26. A single gang electrical box according to claim 25 and further comprising means, coupled to said housing, for releasably coupling said barrier to said housing.

27. A single gang electrical box, the combination comprising:

a single gang housing having a longitudinal axis;

a first supporting flange located on said housing having a first threaded aperture therein intersected by said longitudinal axis and a second threaded aperture therein and transversely spaced from said longitudinal axis; and a second supporting flange located on said housing having a third threaded aperture therein intersected by said longitudinal axis and a fourth threaded aperture therein and transversely spaced from said longitudinal axis, said first and third apertures adapted to receive electrical outlet mounting fasteners coupled to a first outlet, and said second and fourth apertures adapted to receive electrical outlet mounting fasteners coupled to a second outlet which is different from the first outlet.

28. A single gang electrical box according to claim 27, wherein said second aperture is transversely spaced from said longitudinal axis in a first direction.

29. A single gang electrical box according to claim 28, wherein said fourth aperture is transversely spaced from said longitudinal axis in a second direction opposite from said first direction.

30. A single gang electrical box according to claim 27 and further comprising a barrier located in said housing and extending substantially perpendicular to said longitudinal axis.

31. A single gang electrical box according to claim 30 and further comprising means, coupled to said housing, for releasably coupling said barrier to said housing.

32. A single gang electrical box according to claim 27 and further comprising a top wall pivotally coupled to said housing and having an opening therein to allow access to an outlet supported in said housing.

33. A single gang electrical box according to claim 27, wherein the distance "e" between the centerlines of the second and fourth apertures is greater than the distance "d" between the centerlines of the first and third apertures.

34. A single gang electrical box according to claim 33, wherein the distance "d" is about 3¼ inches.

35. A single gang electrical box according to claim 34, wherein the distance "e" is about 3⅝ inches.

36. A single gang electrical outlet according to claim 1, wherein at least one of said mounting flanges is asymmetrical.

37. A single gang electrical outlet according to claim 36, wherein both of said mounting flanges are asymmetrical.

38. A single gang electrical outlet according to claim 37, wherein said main body has a longitudinal central axis extending between said first and second ends, said first mounting flange is substantially offset from said longitudinal central axis on a first side thereof, and said second mounting flange is substantially offset from said longitudinal central axis on a second side thereof which is opposite said first side thereof.

39. A single gang electrical outlet according to claim 38, wherein said first mounting flange has a first opening therein, located on said first side of said longitudinal central axis, for receiving said first mounting fastener, and said second mounting flange has a second opening therein, located on said second side of said longitudinal central axis, for receiving said second mounting fastener.

40. A single gang electrical outlet according to claim 39, wherein a distal portion of each of said first and second mounting flanges has an additional opening along said longitudinal central axis for receiving an additional fastener.

41. A single gang electrical outlet, the combination comprising:

a main body, sized to fit within a single gang electrical box, having first and second ends and a longitudinal central axis extending between said first and second ends;

a first mounting flange extending outwardly from the main body at its first end and having at least two openings for receiving at least one mounting fastener, the openings in said first mounting flange arranged asymmetrically with respect to said longitudinal central axis;

a second mounting flange extending outwardly from the main body at its second end and having at least two openings for receiving at least one mounting fastener, the openings in said second mounting flange arranged asymmetrically with respect to said longitudinal central axis;

a first set of apertures in said main body adjacent the first end thereof;

a power connector coupled to said main body and in communication with said first set of apertures;

at least one additional aperture in said main body adjacent the second end thereof and a first communications connector coupled to said main body and in communication with said at least one additional aperture.

42. A single gang electrical outlet according to claim 41, wherein the openings in said first mounting flange and the openings in said second mounting flange are the inverted mirror images of one another.

43. A single gang electrical outlet according to claim 41, wherein one of the openings of said first mounting flange is offset from said longitudinal central axis on a first side thereof, and one of the openings of said second mounting flange is offset from said longitudinal central axis on a second side thereof which is opposite said first side thereof.

44. A single gang electrical outlet according to claim 43, wherein one of the openings of each of said first and second mounting flanges lies along said longitudinal central axis.

45. A single gang electrical outlet according to claim 43, wherein said main body has a center point along said longitudinal central axis, the centers of the offset openings of said first and second mounting flanges lie on an oblique line that passes through said center point of said main body, and said oblique line is angled about 8° to about 12° from said longitudinal central axis.

46. A single gang electrical outlet according to claim 45, wherein said oblique line is angled about 10° from said longitudinal central axis.

47. A single gang electrical outlet according to claim 41, further comprising a first protrusion extending downwardly from said first mounting flange.

48. A single gang electrical outlet according to claim 47, further comprising a second protrusion extending downwardly from said second mounting flange.

49. A single gang electrical outlet according to claim 48, wherein said first and second protrusions are offset from said longitudinal central axis on opposite sides thereof.

50. A single gang electrical outlet according to claim 41, wherein said first and second mounting flanges are integrally formed with said main body.

51. An electrical assembly, the combination comprising:

an electrical box comprising:

a wall structure defining a box interior, a barrier engaging said wall structure and dividing said box interior, two opposed, outlet-supporting flanges supported by said wall structure, each flange adapted to receive a mounting fastener, and a recess in at least one of said supporting flanges or in the wall structure adjacent thereto; and a single gang electrical outlet mounted in said box interior comprising:

a main body having first and second ends;

a mounting flange extending outwardly from the main body at each end thereof and adapted to receive a mounting fastener and to engage one of said supporting flanges, a downwardly extending protrusion on at least one of said mounting flanges configured to fit into said recess, a first set of apertures in said main body adjacent the first end thereof, a power connector coupled to said main body and in communication with said first set of apertures, at least one additional aperture in said main body adjacent the second end thereof, and a first communications connector coupled to said main body and in communication with said at least one additional aperture, said power connector and said first communications connector defining a slot therebetween, whereby each mounting flange can engage a respective supporting flange with said protrusion disposed in said recess and said barrier disposed in said slot, and a mounting fastener can secure each mounting flange to its respective supporting flange to couple said outlet to said box.

52. An electrical assembly according to claim 51, comprising a recess in each supporting flange or in the wall structure adjacent thereto; and a downwardly extending protrusion on each of said mounting flanges configured to fit into a respective one of said recess.

53. An electrical assembly according to claim 52, wherein said main body has a longitudinal central axis extending between said first and second ends, and said protrusions are offset from said longitudinal central axis on opposite sides thereof.

54. An electrical assembly according to claim 53, wherein said flanges are integrally formed with said main body.

55. An electrical assembly according to claim 53, wherein said mounting flanges are substantially offset from said longitudinal central axis on opposite sides thereof.

* * * * *